US006634111B2

(12) United States Patent
LoRocco

(10) Patent No.: US 6,634,111 B2
(45) Date of Patent: Oct. 21, 2003

(54) MULTIPLE PIN SIGHT FOR AN ARCHERY BOW

(75) Inventor: Paul M. LoRocco, Dallas, TX (US)

(73) Assignee: Tru-Glo, Inc., Dallas, TX (US)

( * ) Notice: Subject to any disclaimer, the term of this patent is extended or adjusted under 35 U.S.C. 154(b) by 0 days.

(21) Appl. No.: 09/895,519

(22) Filed: Jun. 28, 2001

(65) Prior Publication Data

US 2002/0042999 A1 Apr. 18, 2002

Related U.S. Application Data

(60) Provisional application No. 60/240,123, filed on Oct. 13, 2000.

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS 2,574,599 A * 11/1951 Steiber ..... 124/23.1
3,798,783 A * 3/1974 Carella ..... 33/265
4,328,625 A * 5/1982 Carella ..... 33/265
5,956,854 A * 9/1999 Lorocco ..... 33/241
6,418,633 B1 * 7/2002 Rager ..... 33/265

* cited by examiner

*Primary Examiner*—Christopher W. Fulton
*Assistant Examiner*—Tania C. Courson
(74) *Attorney, Agent, or Firm*—Fish & Richardson P.C.

(57) ABSTRACT

A multiple range sight for an archery bow having at least a first and a second aiming indicia. The aiming indica include a proximal end of a light-gathering optical fiber, wherein light is emitted from the proximal end. Further a holder supports the aiming indicia and is attachable to the archery bow. The first aiming indicia is provided for sighting a target at a first range. The second aiming indicia is provided for sighting a target at a second range. An area of the first aiming indica directly visible to an archer when sighting the target is sized in inverse relation to the length of the range such that the aiming indicia does not obscure the target. An area of the second aiming indicia directly visible to an archer when sighting the target is sized in inverse relation to the length of the range, and is of a different size than the area of the first aiming indicia.

18 Claims, 2 Drawing Sheets

OPTIONAL LOCK UP

OPTIONAL ROUND STOCK (PINS VIEWED IN THIS DIRECTION)

MULTIPLE PIN SIGHT FOR AN ARCHERY BOW

This application claims priority from U.S. Provisional Application Ser. No. 60/240,123, filed Oct. 13, 2000, the disclosure of which is hereby incorporated by reference.

BACKGROUND OF THE INVENTION

1. Technical Field

This invention relates generally to a sight for an archery bow, and more particularly to a multiple range sight having aiming indicia utilizing light-gathering optical fibers.

2. History of Related Art

Multiple range sights are commonly used in archery applications to provide multiple indicias, or aiming dots, for targets spaced at various distances from the archer. For example, if multiple dots are aligned vertically, one above the other, the upper most pin dot would be used for a close target, in which there would be very little elevational compensation for the flight of the arrow, and the bottom pin dot would be used for a target at a greater distance from the archer.

In many prior art sights, the aiming indicia provided at the end of pins have all been of the same diameter. Others provide aiming indicia of different colors or sizes to differentiate between the aiming indicia, but with no regard for the distance of the target. The disadvantage of this arrangement is that a pin dot diameter conducive for aiming at a close target would cover the desired impact area of a target at a greater distance. For example, if the diameter of the pin dot is 1.5 mm (0.060 inches) and positioned about 75 cm (30 inches) from the archer's eye, it would cover about 20% of a 12 cm (5 inch) target at 12 m (40 feet). However, if the same pin size is used for a more distant target, for example, 36 m (40 yards), almost 60% of the target area would be blocked by the pin. While such a large blockage of the actual target area may be somewhat compensated for by a concentric target arrangement, it becomes a serious aiming problem in game hunting. For example, an adult whitetail deer, weighing about 70 kg (150 pounds), has a heart area of about 12 cm (5 inches). If the pin dot covers a major portion of that area, it makes precise centering on the heart extremely difficult.

Therefore, there is a need for a multiple range sight which considers the apparent size of each aiming indicia in relation to the target, and thus accounts for the range of the target.

SUMMARY OF THE INVENTION

The present invention is directed to a multiple range sight having aiming indicia of various sizes dependent on the range to which the aiming indicia is sighted. The multiple range sight has a first elongated light-gathering optical fiber with a proximal end and a distal end spaced from the proximal end. Light is emitted from the proximal end of the first optical fiber to provide a first aiming indicia for sighting a target at a first range. The sight also has a second elongated light-gathering optical fiber with a proximal end and a distal end spaced from the proximal end. Light is emitted from the proximal end of the second optical fiber to provide a second aiming indicia for sighting a target at a second range. A holder is adapted to support the first and second optical fibers and is attachable to an archery bow. The second range is longer than the first range, and accordingly the second aiming indicia is smaller than the first aiming indicia.

BRIEF DESCRIPTION OF THE DRAWINGS

A more complete understanding of the structure and operation of the present invention may be had by reference to the following detailed description when taken in conjunction with the accompanying drawings, wherein.

DESCRIPTION OF THE PREFERRED EMBODIMENTS

Figure 1:
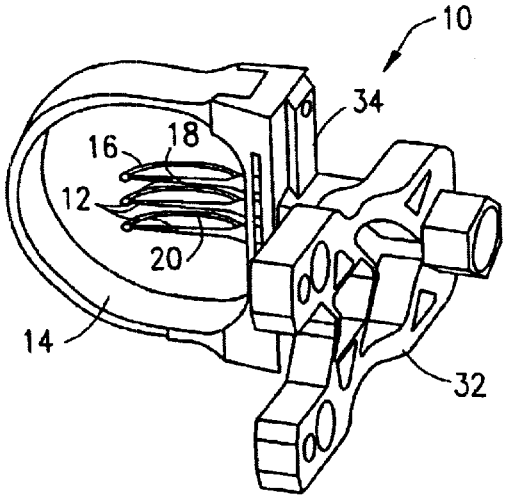
FIG. 1 is a perspective view of a multiple range sight constructed in accordance with this invention.
Figure 2:
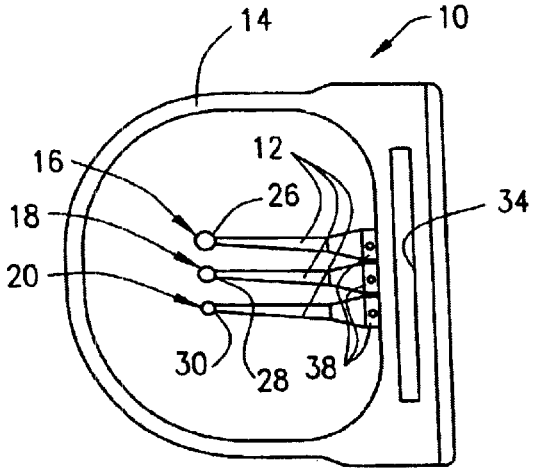
FIG. 2 is an elevational view of a multiple range sight constructed in accordance with this invention.

A multiple range sight, or multiple pin sight 10 is illustrated in FIG. 1. The multiple pin sight 10 includes a plurality of pins 12 mounted in a holder 14. Importantly, each one of the pins 12 has an elongated fluorescent light gathering optical fiber, identified top-to-bottom by respective reference numbers 16, 18, and 20, mounted thereon, as shown in FIGS. 1 and 2. Fluorescent light gathering optical fibers gather light through the external circumferential wall of the fiber, and direct the gathered light to opposed end faces 22, 24 of the fiber. Light is emitted from the end faces and provides a brilliant dot that can readily be seen, both in bright sunlight or low light conditions.

Importantly, in the present invention, each of the fluorescent elongated light gathering optical fibers 16, 18, 20 in respective ones of the pins 12 have a distinct diameter that is different from the diameter of any other elongated optical fiber mounted on any other pin 12 of the multiple pin sight 10. In a typical arrangement, the uppermost pin 12 has an elongated light gathering optical fiber 16 disposed therein having a diameter of 1.0 mm (0.040 inches), thereby providing an aiming indicia 26 having a diameter of approximately 1.0 mm (0.040 inches). The intermediately disposed elongated pin 12 has an elongated optical fiber 18 disposed therein having a diameter of 0.7 mm (0.030 inches), thereby providing an aiming indicia 28 having a diameter of approximately 0.7 mm (0.030 inches). The bottom pin 12 has an elongated optical fiber 20 disposed thereon has a diameter of 0.5 mm (0.020 inches), thereby providing an aiming indicia 30 having a diameter of approximately 0.5 mm (0.020 inches).

In use, an archer using the multiple pin sight 10 embodying the present invention would vertically adjust the uppermost pin 12 to provide a relatively large diameter aiming indicia 26 for a close target. The intermediate pin 12 would be adjusted for an intermediate target in which a smaller aiming indicia 28 than that used for a close target would be beneficial, and adjust the bottom pin 12 to provide a relatively small aiming indicia 30 for use at a more distant target. Thus, the size of the aiming indicia 26, 28, 30, and more specifically, the area viewed by an archer when sighting a target with a particular aiming indicia, is sized in inverse relation to the distance from the target. One of ordinary skill in the art will appreciate that an exact inverse relationship is not necessary to achieve the objects of this invention, and that size of fibers can be chosen to coincide with commonly available fiber sizes. When referring herein to the size, area, or diameter of the aiming indicia being in inverse relationship to distance from the target, it is meant that a longer distance from the target will be used with a smaller fiber, of unique or standard size.

Figure 14:
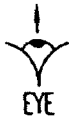
FIG. 14 is planar sectional view of another pin configuration for use with the multiple range sight as shown in FIG. 2.
Figure 14:
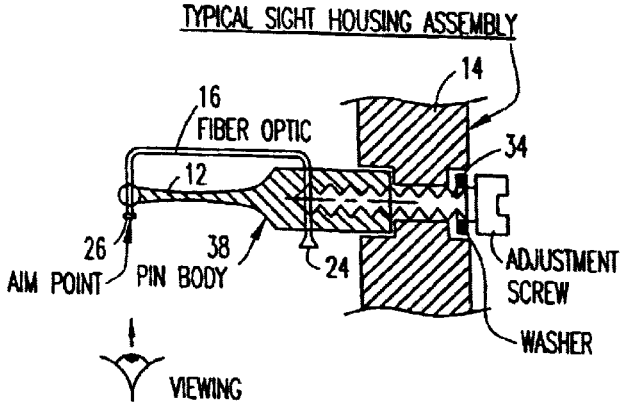
Figure 11:
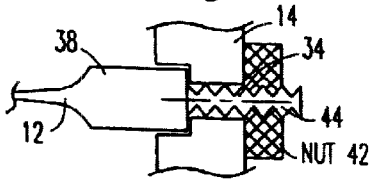
FIG. 11 is planar sectional detail of a pin mounting arrangement for use with the multiple range sight as shown in FIG. 2.
Figure 13:
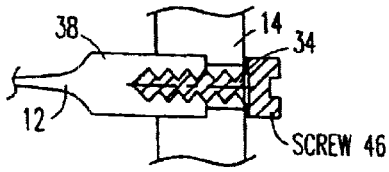
FIG. 13 is planar sectional detail of another pin mounting arrangement for use with the multiple range sight as shown in FIG. 2.

With specific reference to FIG. 1, the multiple pin sight 10 embodying the present invention is shown mounted on a holder 14 that is secured on a mounting bracket 32 that is attachable to a bow. Each of the pins 12 are mounted in a slot 34 provided on the holder 14 and secured in the slot 34 by an adjustment screw or nut 46, 42 as illustrated in FIGS. 11, 13 and 14. In some of the embodiments of the pin configuration 12, the optical fibers 16, 18, 20 may have only the first end face 22 visible to the archer, as illustrated in FIGS. 3, and 5–7, whereas in other embodiments, both end faces, 22, 24 of the elongated optical fibers 16, 18, 20 are visible to the user of the sight 10. Many people find the presence of two dots to be somewhat distracting, and for that reason the single viewing dot provided by only one end face 22 of the optical fiber 16, 19, 20 is generally preferred. However, both arrangements are shown for the purpose of illustrating alternative embodiments of the sight 10 embodying the present invention.

In FIGS. 3–8, 10, 12 and 14 only one pin 12 is shown, and the optical fiber disposed thereon is identified by the reference numeral 16 for illustration purposes. However, it should be understood that the illustration and the following description equally applies to all three light-gathering optical fibers 16, 18, 20.

Figure 3:
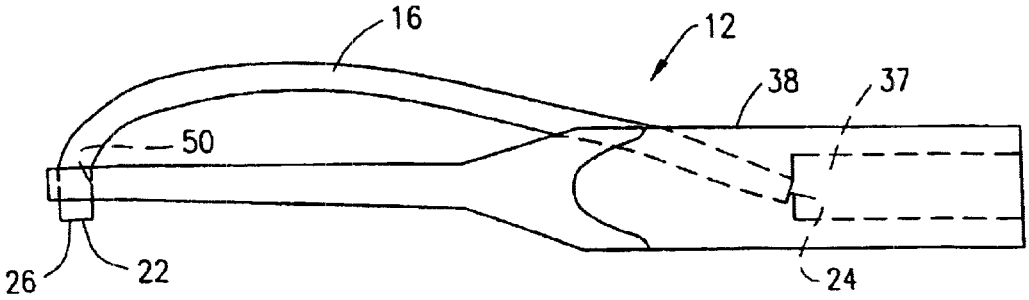
FIG. 3 is planar sectional view of a pin for use with the multiple range sight as shown in FIG. 2.

The internally disposed second pin 12, illustrated in FIG. 3, has a tritium gas vial 37 internally disposed in the pin 12 at a position adjacent the second end face 20 of the light-gathering optical fiber 16. The tritium vial 37 emits light that is absorbed by the adjacent second end face 24 and transmitted along the optical fiber 16 to the first end face 22, thereby providing a brilliant dot useful as an aiming indicia under extremely low light, or even night time conditions. In this embodiment, the light-gathering optical fiber 16 may have a clear core.

Figure 4:
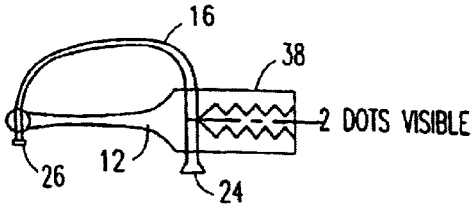
FIG. 4 is planar sectional view of another pin configuration for use with the multiple range sight as shown in FIG. 2.

In FIG. 4, the elongated light gathering optical fiber 16 has an exposed portion between the indicia end of the pin 12 and the body portion 38 of the pin 12. In this embodiment, the optical fiber 16 passes completely through the body portion 38 of the pin 12 and both end faces 22, 24 of the fiber 16 are visible to the user.

Figure 5:
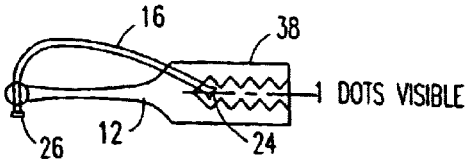
FIG. 5 is planar sectional view of another pin configuration for use with the multiple range sight as shown in FIG. 2.

In FIG. 5, the second end face 24 of the elongated optical fiber 16 is disposed in a central threaded cavity, and therefore is blocked from direct viewing by the user.

Figure 6:
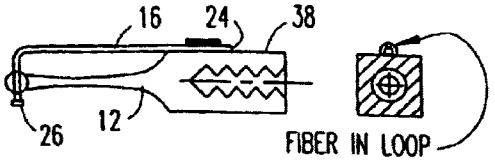
FIG. 6 is planar sectional view of another pin configuration for use with the multiple range sight as shown in FIG. 2.

In FIG. 6, the second end of the optical fiber 16 is threaded through a longitudinal loop provided on the body portion 38 of the pin 12, and the second end face 24 of the optical fiber 16 is directed perpendicular to the line of sight of the user, and thereby not directly visible to the user.

Figure 7:
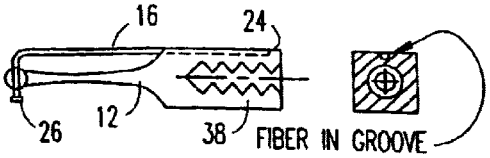
FIG. 7 is planar sectional view of another pin configuration for use with the multiple range sight as shown in FIG. 2.

In a similar manner, the second end of the elongated optical fiber 16 illustrated in FIG. 7 is disposed in a longitudinal groove provided on the outside of the body of the pin 12 and therefore the second end face 24 of the optical fiber 16 is not directly viewable by the user when aiming at a target.

Figure 8:
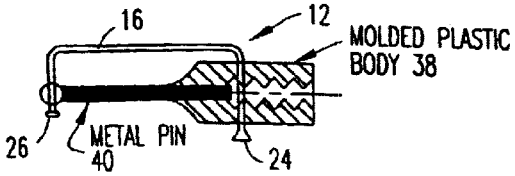
FIG. 8 is planar sectional view of another pin configuration for use with the multiple range sight as shown in FIG. 2.
Figure 9:
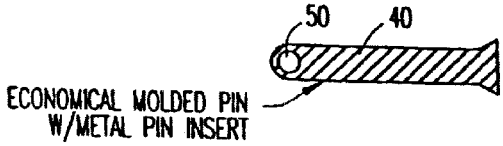
FIG. 9 is planar sectional detail view of a pin insert configuration for use with the multiple range sight as shown in FIG. 2.

The embodiment shown in FIG. 8 is similar to that described above with respect to FIG. 4, with the exception that a metal pin insert 40 is molded in a plastic body portion 38 to form the pin 12. This arrangement has significant cost advantages due to the reduced machining required of an all metal pin arrangement. FIG. 9 is a longitudinal cross-sectional view of metal pin insert 40.

Figure 10:
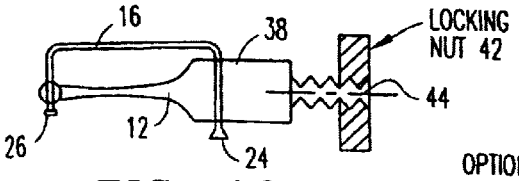
FIG. 10 is planar sectional view of another pin configuration for use with the multiple range sight as shown in FIG. 2.
Figure 12:
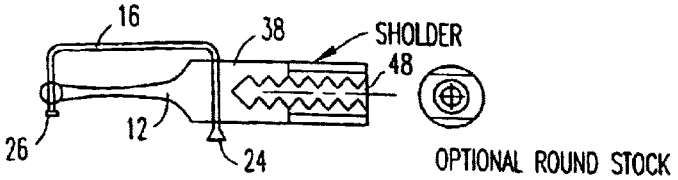
FIG. 12 is planar sectional view of another pin configuration for use with the multiple range sight as shown in FIG. 2.

The embodiments shown in FIGS. 10 and 12 are similar to that illustrated above with respect to FIG. 4, with a mounting arrangement for each embodiment illustrated in greater detail in FIGS. 11 and 13, respectively. In the FIG. 10 arrangement, a lock nut 42 is threaded or engaged on an end of a threaded stub 44 extending outwardly from the body portion 38 of the pin 12, whereas in the FIG. 12 arrangement, a screw 46 is threadably engaged in internal threads 48 provided in a square shank of an otherwise round body portion 38 of the pin 12.

FIG. 14 further illustrates a preferred arrangement of the pin mounting configuration illustrated in FIG. 10. In each of the arrangements, the pins are vertically adjustable along the slot 34 provided in the housing 14.

Typically, the pins 12 have a rectangular base 36 that is received with a rectangular relief provided in the housing 14. Thus, when the lock nut 42 or adjusting screw 46 is tightened, rotation of the pin 12 is prevented by the mating shape of the pin 12 within the recess provided in the housing 14. The distal end 38 of each of the pins 12 has a circular hole 50 for receiving and supporting the first end of each of the respective elongated optical fiber 16, 18, 20 disposed on the pin 12.

While the present invention has been illustrated with specific exemplary embodiments of mounting arrangements for the elongated light-gathering optical fibers 16, 18, 20 in the respective pins 12, along with exemplary distinctively different illustrative diameters for each of the elongated optical fibers 16, 18, 20 disposed in respective pins 12 of the sight 10, it should be recognized that changes in those specific mounting arrangements and in the illustrative specific different diameters may be made without departing from the spirit of the present invention. It is envisioned that the different diameters may range for about 0.3 mm (0.015 inch) to about 2.0 mm (0.080 inch) or larger. In addition, the archery sight 120 may have more than the three pins 12 as illustrated, for example five pins 12 with at least two of the pins 12 having light-gathering optical fibers 16 of different diameters.

I claim:

1. A multiple range sight for an archery bow comprising:

a first elongated light-gathering optical fiber having a proximal end and a distal end spaced from said proximal end, wherein light is emitted from the proximal end to provide a first aiming indicia for sighting a target at a first range;

a second elongated light-gathering optical fiber having a proximal end and a distal end spaced from said proximal end, wherein light is emitted from the proximal end to provide a second aiming indicia for sighting a target at a second range;

a holder adapted to support the first and second optical fibers, the holder being attachable to the archery bow; and wherein the second range is longer than the first range, and the second optical fiber has a diameter smaller than the first optical fiber adapted to thereby obscure a smaller area of the target at the second range than would be obscured by the first optical fiber.

2. The multiple range sight of claim 1 further comprising a third elongated light-gathering optical fiber having a proximal end from which light is emitted to provide a third aiming indicia for sighting a target at a third range; and wherein the third range is longer than the second range and the third optical fiber has a diameter smaller than the diameter of the second optical fiber.

3. The multiple range sight of claim 1 wherein the second aiming indicia is positioned elevationally below the first aiming indicia when the sight is mounted on the archery bow.

4. The multiple range sight of claim 1 wherein a position of the first optical fiber is vertically adjustable relative to the holder.

5. The multiple range sight of claim 1 wherein the diameter of the first optical fiber is in inverse relation to the distance of the first range.

6. The multiple range sight of claim 1 wherein the first optical fiber is disposed on a pin extending from the holder and the distal end of the first optical fiber is secured to an exterior of the pin so as to be blocked from an archer's sight when viewing the aiming indicia.

7. The multiple range sight of claim 1 wherein the first optical fiber is disposed on a pin extending from the holder and the first optical fiber passes through the pin such that the distal end is visible to an archer when viewing the aiming indicia.

8. The multiple range sight of claim 1 wherein the first optical fiber is disposed on a pin extending from the holder and the distal end of the first optical fiber is embedded in the pin so as to be blocked from an archer's sight when viewing the aiming indicia.

9. The multiple range sight of claim 8 further comprising a light emitting member adjacent the distal end of the first optical fiber.

10. The multiple range sight of claim 9 wherein the light emitting member comprises tritium.

11. A multiple range sight for an archery bow having multiple aiming indicia, comprising:

a first aiming indicia for sighting a target at a first range, comprising a proximal end of an elongated light-gathering optical fiber, wherein light is emitted from the proximal end;

a second aiming indicia for sighting a target at a second range, comprising a proximal end of an elongated light-gathering optical fiber, wherein light is emitted from the proximal end;

a holder adapted to support the first and second aiming indicia, the holder being attachable to the archery bow; and wherein an area of the first aiming indicia directly visible to an archer when sighting the target at a first range is sized in inverse relation to a length of the first range and adapted to obscure less of the target if the first range is longer than if the first range is shorter, and wherein the area of the first aiming indicia directly visible to the archer is different than an area of the second aiming indicia directly visible to the archer when sighting a target.

12. The multiple range sight of claim 11 wherein the area of the second aiming indicia directly visible to the archer sighting a target is sized in inverse relation to a distance of the second range.

13.The multiple range sight of claim 11 wherein the area of the first aiming indicia is larger than the area of the second aiming indicia and the first range is shorter than the second range.

14. The multiple range sight of claim 13 wherein the first aiming indicia is elevationally above the second aiming indicia when the sight is mounted on the archery bow.

15. The multiple range sight of claim 11 further comprising a pin for supporting the optical fiber of the first aiming indicia; and wherein the optical fiber of the first aiming indicia has a distal end spaced from the proximal end, and the optical fiber passes through the pin such that the distal end is visible to the archer when viewing the first aiming indicia.

16. The multiple range sight of claim 11 further comprising a pin for supporting the optical fiber of the first aiming indicia; and wherein the optical fiber of the first aiming indicia has a distal end spaced from the proximal end, and the distal end is embedded in the pin so as to be blocked from the archer's sight when viewing the first aiming indicia.

17. The multiple range sight of claim 16 further comprising a light emitting member adjacent the distal end of the optical fiber of the first aiming indicia.

18. The multiple range sight of claim 17 wherein the light emitting member comprises tritium.

* * * * *